US006905186B2

(12) United States Patent
Kojima

(10) Patent No.: US 6,905,186 B2
(45) Date of Patent: Jun. 14, 2005

(54) IMAGE RECORDING APPARATUS

(75) Inventor: Toshiya Kojima, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/629,677

(22) Filed: Jul. 30, 2003

(65) Prior Publication Data

US 2004/0021724 A1 Feb. 5, 2004

(30) Foreign Application Priority Data

Jul. 30, 2002 (JP) ..... 2002-222063

(51) Int. Cl.[7] ..... B41J 29/393
(52) U.S. Cl. ..... 347/19
(58) Field of Search ..... 347/19, 16, 37

(56) References Cited

U.S. PATENT DOCUMENTS 5,736,996 A * 4/1998 Takada et al. ..... 347/19
5,825,378 A * 10/1998 Beauchamp ..... 347/19
6,412,902 B2 7/2002 Matsumoto et al.
2001/0004284 A1 6/2001 Fukuda et al.

FOREIGN PATENT DOCUMENTS

JP 11-198358 A 7/1999

* cited by examiner

*Primary Examiner*—Thinh Nguyen
(74) *Attorney, Agent, or Firm*—Sughrue Mion, PLLC

(57) ABSTRACT

A test pattern is recorded in a margin of recording paper. A camera of a test pattern imaging device takes the image of the test pattern. A test pattern analyzer calculates deviation in feeding distance of the recording paper, and in movement of an inkjet head based on image data. The test pattern analyzer also detects a faulty nozzle. The feeding distance of the recording paper and the carrying distance of the inkjet head are corrected based on deviation, so that print imperfection caused thereby is prevented. The faulty nozzle is subjected to correction processes, such as a nozzle wiping process, an ink discharge process, an ink suction process and the like.

11 Claims, 9 Drawing Sheets

IMAGE RECORDING APPARATUS

BACKGROUND OF THE INVENTION

1. Field of the Invention

The present invention relates to an image recording apparatus which reduces deviation in the feeding distance or feeding speed of a recording material and the movement of a printing head.

2. Background Arts

Various printers such as an inkjet printer, a thermal printer and the like are generally used for recording an image on recording paper. When some malfunction occurs in a recording device of the printer, image quality of the recorded image becomes inferior. Taking a case of the inkjet printer, for example, a nozzle for ejecting ink is sometimes clogged with the ink. The clogging causes imperfection in ink ejection, since an ejection amount is decreased. Imperfection in ink ejection causes streaky color unevenness and density unevenness which appear on the recorded image.

When color unevenness or density unevenness happens, the printer is switched over a head cleaning mode to correct imperfection in ink ejection of the recording device. Since color unevenness or density unevenness causes waste of the ink and the recording paper, some business-use printers automatically print test patterns to correct imperfection in ink ejection at regular time intervals. (for example, United States Patent Publication No. 2001/0004284 and Japanese Patent Laid-Open Publication No. 11-198358.) U.S. Pat. No. 6,412,902 also discloses a printer which prints test patterns on a margin between images, in order to reduce the waste of recording paper.

The cleaning of the printing head, as described above, can correct print imperfection caused by the recording device. The streaky unevenness, however, still appears, since it is caused by deviation in the feeding distance of the recording paper and the movement of the printing head.

These days, various types of recording paper having different texture, thickness, width and the like have been used. The friction between the recording paper and a pair of feed rollers is changed depending on the type of recording paper, so that the feeding distance or feeding speed of the recording paper deviates. The friction between the recording paper and the feed roller pair slightly varies in accordance with the variation in environment temperature and humidity. The diameter of the feed roller also varies in accordance with the variation in environment temperature. Therefore, there is a problem that the deviation in the feeding distance or feeding speed of the recording paper causes a white streak appearing in an unprinted area, or a black streak appearing in an area where adjacent print lines are overlapped.

SUMMARY OF THE INVENTION

An object of the present invention is to provide an image recording apparatus which reduces deviation in the feeding distance or feeding speed of recording paper and the movement of a printing head, in order to prevent streaky unevenness and the like caused thereby.

Another object of the present invention is to provide an image recording apparatus which efficiently detects a faulty recording device.

To achieve the above objects, an image recording apparatus according to the present invention comprises a recording head for recording an image, a detection means, a test pattern analyzer, and a correction means. The recording head, having plural neatly arranged recording devices, records a test pattern in a margin of the image. The detection means detects the recorded test pattern. The test pattern analyzer analyzes signals from the detection means, to calculate deviation in relative movement or relative speed of the recording paper or the recording head. Then, the correction means corrects the relative movement or relative speed on the basis of the deviation.

The test pattern may include first check pattern. The first check pattern comprises plural first check lines which are recorded by the same recording device driven at predetermined time intervals on the basis of predetermined drive signals, while the recording material is relatively moved to the recording head. The test pattern analyzer measures distance between the first check lines to determine deviation in the relative movement or relative speed.

The test pattern may include second check pattern. The second check pattern comprises plural second check lines which are recorded by the same recording device for predetermined elapsed time on the basis of predetermined drive signals, while the recording material is relatively moved to the recording head. The test pattern analyzer measures the length of the second check line to determine deviation in the relative movement or relative speed.

The test pattern may include at least one of a faulty recording device check pattern, a calibration pattern, and a solid fill check pattern.

According to the present invention, the deviation in the relative moving distance of the recording paper or the recording head is corrected based on the analysis result of the test pattern. Accordingly, it is possible to prevent the occurrence of print imperfection, such as streaky unevenness and the like, caused by the deviation thereof. If both of check patterns for detecting the faulty nozzle and for calculating the deviation are used at the same time, it is possible to prevent the occurrence of general print imperfection.

BRIEF DESCRIPTION OF THE DRAWINGS

The above objects and advantages of the present invention will become apparent from the following detailed descriptions of the preferred embodiments when read in association with the accompanying drawings, which are given by way of illustration only and thus do not limit the present invention. In the drawings, the same reference numerals designate like or corresponding parts throughout the several views, and wherein.

DETAILED DESCRIPTION OF THE EMBODIMENTS

Figure 1:
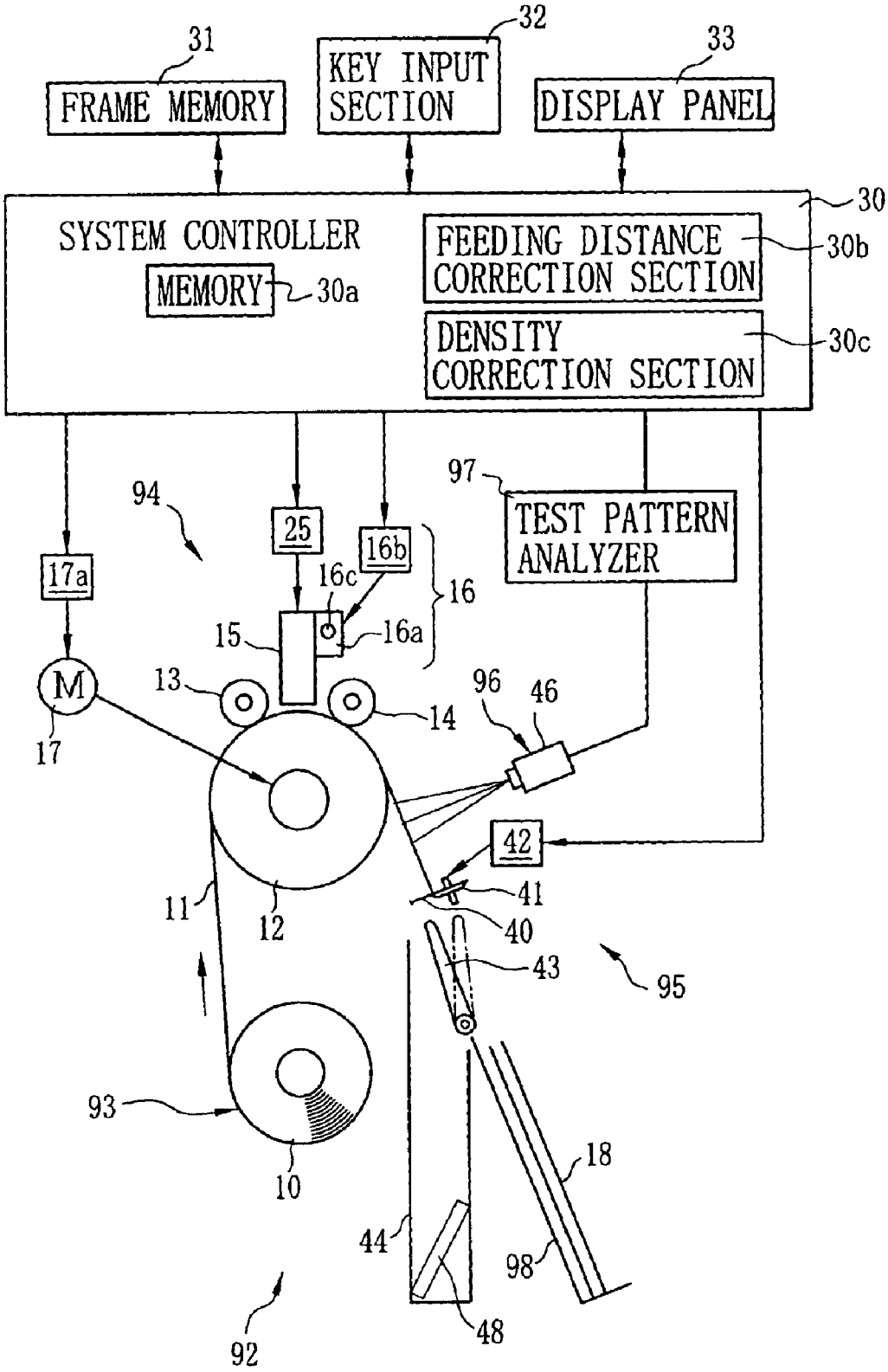
FIG. 1 is a schematic view a serial print type inkjet printer according to the present invention.
Figure 2:
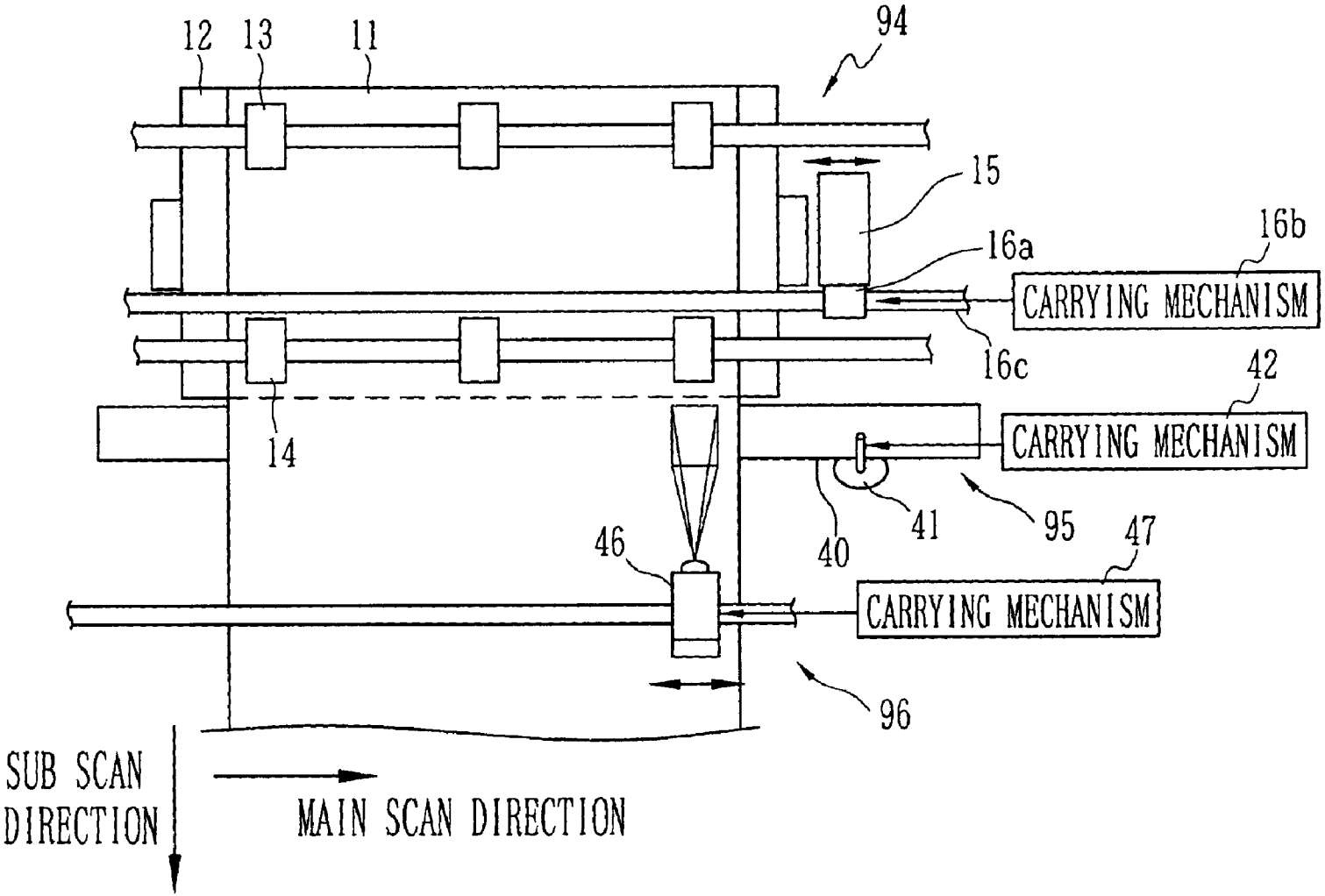
FIG. 2 is a plan view of a printing device and a test pattern imaging device in the printer of FIG. 1.

An embodiment of the present invention will be hereinafter described with taking a serial print type inkjet printer (a serial printer) as an example. Referring to FIGS. 1 and 2, an inkjet printer 92 is provided with a paper supply unit 93, a printing device 94, a paper cutter 95, a test pattern imaging device 96, a test pattern analyzer 97, a tray 98 and the like. A recording paper roll 10 is set in the paper supply unit 93. The recording paper roll 10 drawn out by feeder rollers (not illustrated) is fed into the printing device 94 as recording paper 11.

The printing device 94 comprises a platen roller 12, a set of pinch rollers 13 and 14, an inkjet head 15, and a head carriage 16 as head carrying means to move the inkjet head 15 in a main scan direction. The pinch rollers 13 and 14 disposed above the platen roller 12 press the recording paper 11 against the platen roller 12 in order to prevent the recording paper 11 from sagging.

Figure 3:
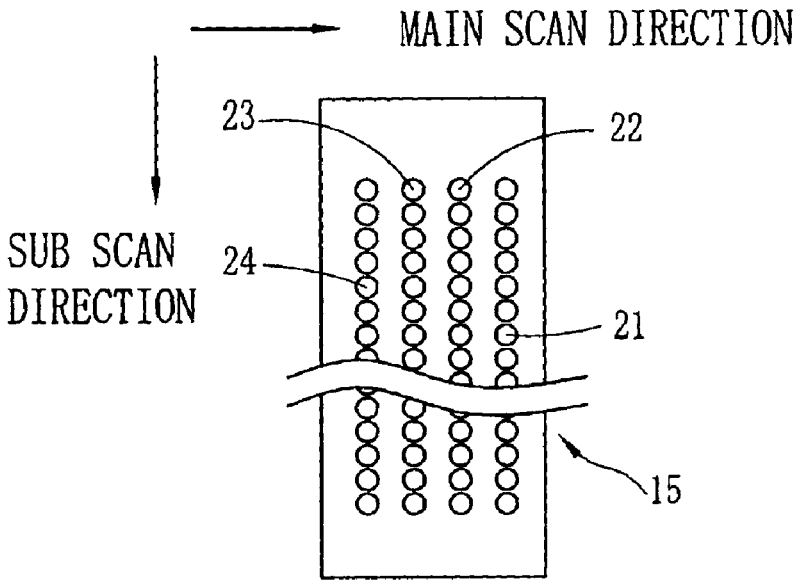
FIG. 3 is an enlarged front view of an inkjet head.

Referring to FIG. 3, the inkjet head 15 has yellow (Y) nozzles 21, magenta (M) nozzles 22, cyan (C) nozzles 23, and black (K) nozzles 24. The nozzles 21 to 24 of each color are neatly aligned in a sub scan direction. In the inkjet head 15, as is well known, piezoelectric elements are provided in an ink flowing path near each nozzle 21 to 24. When the piezoelectric elements constrict and release the ink flowing path, ink is discharged or supplied.

The head carriage 16 carries the inkjet head 15 in the main scan direction, as shown in FIG. 2, so that a full color image of one line is printed along the main scan direction. The head carriage 16 includes a carriage body 16*a*, a carrying mechanism 16*b*, a guide shaft 16*c* and the like. The platen roller 12 rotated by a pulse motor 17 feeds the recording paper 11 by one line in the sub scan direction, whenever the image of one line is printed. A system controller 30 controls the pulse motor 17 via a driver 17*a*. The platen roller 12 and the pulse motor 17 compose recording paper feeding means in the sub scan direction.

A head driver 25, as shown in FIG. 1, controls each piezoelectric element of the ink jet head 15. The head driver 25 connected to the system controller 30 provides each piezoelectric element with drive signals based on image data. The system controller 30 is connected to a frame memory 31, a key input section 32, a display panel 33 and the like. Image data read by an image reader and the like is stored in the frame memory 31. The system controller 30 calculates drive amount of the piezoelectric elements of each color nozzle 21 to 24 on the basis of image data, and sends it to the head driver 25. The head driver 25 drives each piezoelectric element in synchronization with the operation of the head carriage 16. Accordingly, ink droplets the size of which correspond to image data are ejected onto the recording paper 11, so that the color inks of Y, M, C and K adhere to the recording paper 11. The inkjet head 15 records the image of one line while moving in the main scan direction. Upon completion of one line image recording in the main scan direction, the pulse motor 17 rotates to feed the recording paper 11 by one line in the sub scan direction. The recording paper 11 may be so fed as to complement the space between dots recorded in the main scan direction. Repeating the foregoing operations, the full-color image of a single picture frame is recorded on the recording paper 11. To achieve high image quality, one or plural gradient expressions such as dot diameter control, dot density control and the like are adopted in recording the image.

The paper cutter 95 comprises a fixed blade 40, a rotatable blade 41, a blade carrying mechanism 42, and a shift guide 43. The long fixed blade 40 is disposed along the width direction of the recording paper 11. Since the blade carrying mechanism 42 carries the rotatable blade 41 along the fixed blade 40, the recording paper 11 is cut in its width direction between adjacent image frames.

The shift guide 43 is movable between a guide position illustrated by a chain double-dashed line and an evacuated position illustrated by a solid line. When the shift guide 43 is at the guide position, the recording paper 11 on which test patterns 50 and 51 are recorded is guided to a waste paper box 44. Then, the recording paper 11 is cut as a sheet of waste paper 48. When the shift guide 43 is at the evacuated position, the recording paper 11 is guided to the tray 98 to be cut as a print sheet 18. Only a part of the print sheet 18 on which the test patterns 50 and 51 are recorded may be cut and guided to the waste paper box 44 as the waste paper.

The test pattern imaging device 96 comprises a camera 46 and a camera carrying mechanism 47 (refer to FIG. 2) for carrying the camera 46 in the width direction of the recording paper 11. The test pattern imaging device 96 takes the image of the test patterns recorded on the recording paper 11 to obtain image data. In a case where the test patterns are recorded across plural picture frames, the borderline of picture frames is detected by a pattern matching process. Image data merged with respect to the borderline becomes continuous test pattern image data. Image data is sent to the pattern analyzer 97. On the basis of test pattern image data, the pattern analyzer 97 judges if print imperfection appears. The result of judgment is sent to the system controller 30.

Figure 4:
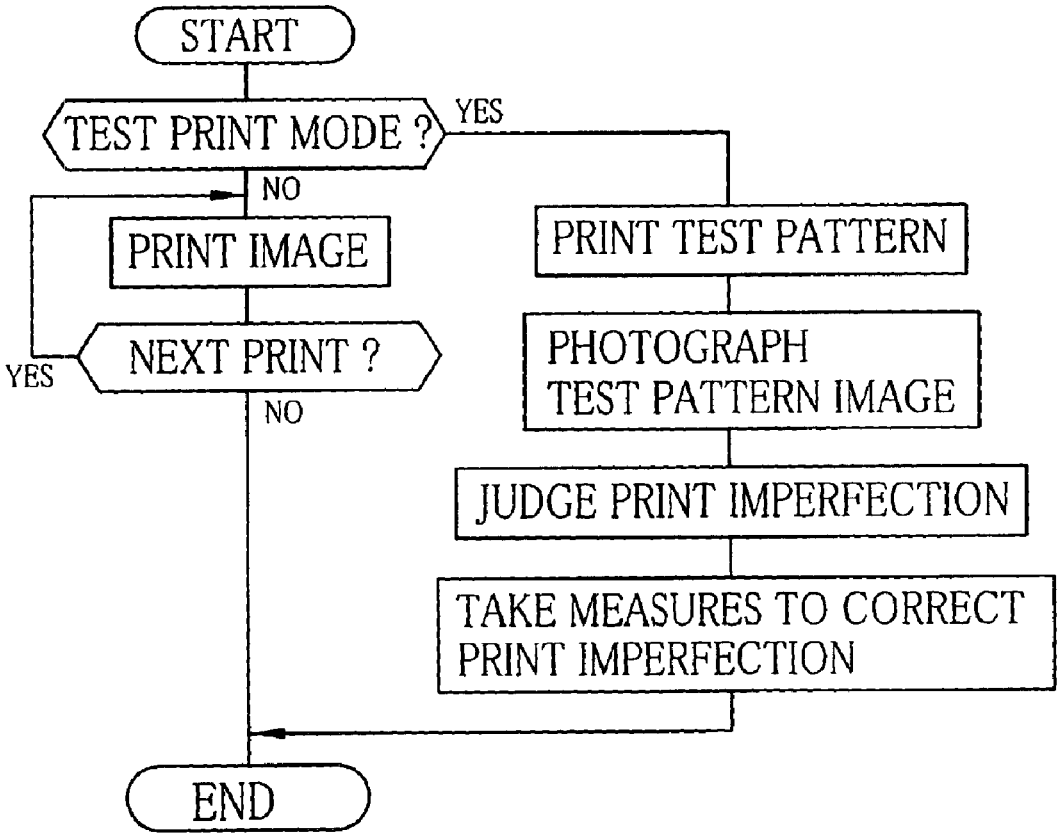
FIG. 4 is a flow chart showing the processes of the inkjet printer.

The system controller 30 has a normal print mode and a test print mode. In the normal print mode, as shown in FIG. 4, the system controller 30 controls each part to record an image on the recording paper 11. Then, as long as there is another image to be recorded, the system controller 30 continues recording operation. Upon completing the record of all images, the inkjet printer 92 ends the recording operation. In the test print mode, the system controller 30 records the test patterns 50 and 51 (refer to FIGS. 5 and 6). Then, the test patterns 50 and 51 are taken in the test pattern imaging device 96, and image data is sent to the test pattern analyzer 97. On the basis of image data of the test patterns 50 and 51, the test pattern analyzer 97 judges if print imperfection happens. If the feeding imperfection of the recording paper 11 is detected from image data, for example, a feeding distance correction section 30*b* (refer to FIG. 1) corrects the feeding distance of the recording paper 11. If the clogging of the nozzle is detected, a nozzle wiping process, an ink discharge process, an ink suction process and the like are carried out. If the density of each color deviates from predetermined standard density, a density correction section 30*c* (refer to FIG. 1) adjusts the size of ink droplets by changing applied voltage to the piezoelectric elements, for example. When the print imperfection occurs, the system controller 30 may display a warning massage on the display panel 33, in order to inform a user of the occurrence of print imperfection. Otherwise, the system controller 30 may generate an alarm for the same purpose.

Figure 5:
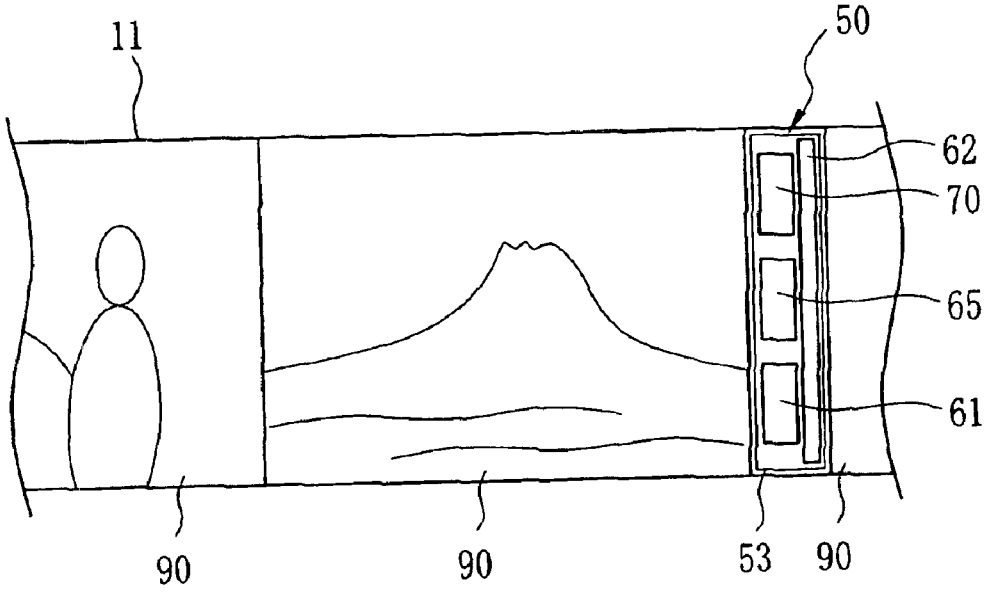
FIG. 5 is an explanatory view showing an example of a test pattern.
Figure 6:
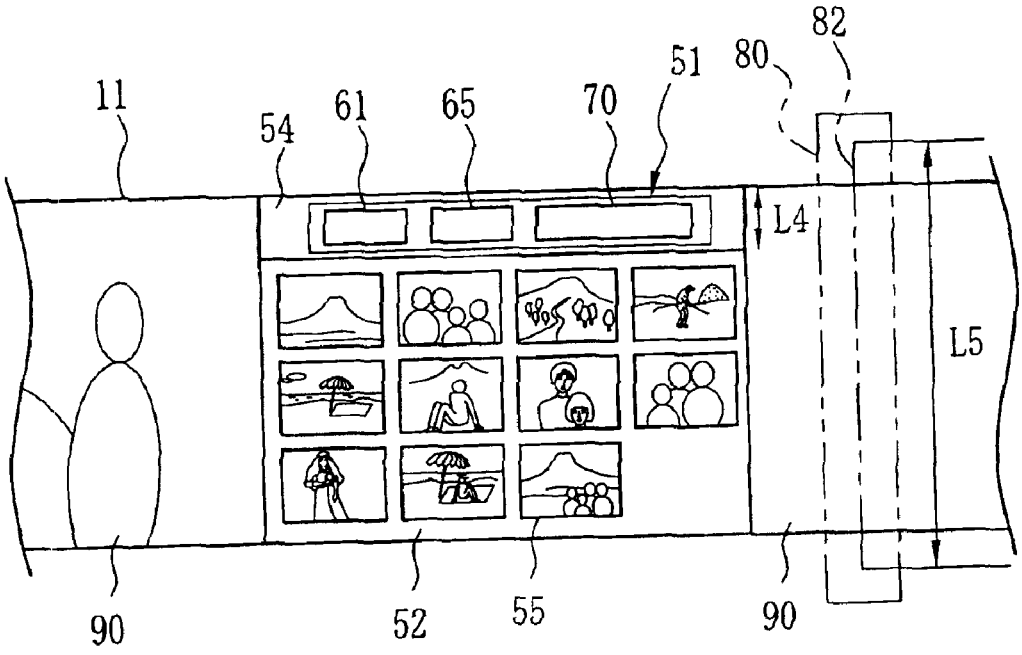
FIG. 6 is an explanatory view showing another example of the test pattern.

The test pattern 50 shown in FIG. 5 is recorded in a margin 53 between image areas 90. The test pattern 51 shown in FIG. 6 is recorded in a margin 54 between an image area 52 and one side edge of the recording paper 11. A test pattern may be recorded in a L-shaped margin (not illustrated) which is a combination of the margin 53 of FIG. 5 and the margin 54 of FIG. 6. The user can select the print position, format and the like of the test patterns 50 and 51 by operating the key input section 32. Since the margins 53 and 54 are efficiently used for recording the test patterns 50 and 51, it is possible to reduce the waste of recording paper 11. In a case of FIG. 6, the image area 52 adjacent to the margin 54 is narrower than the other image areas 90 in width. In other words, the sizes of the image areas 52 and 90 are different from each other.

Accordingly, it is preferable that an image unsusceptible to difference in size, like an index image 55, is recorded in the image area 52 adjacent to the margin 54.

Figure 7:
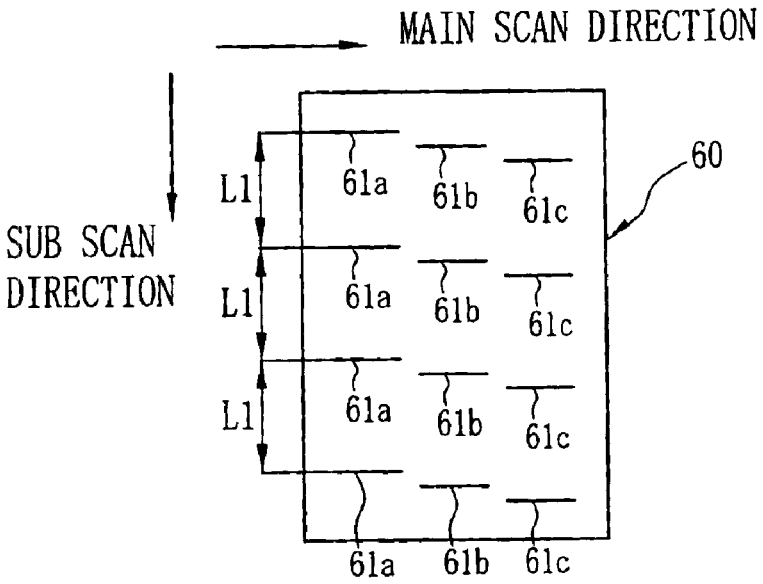
FIG. 7 is an explanatory view showing an example of a paper feeding distance check pattern.

FIGS. 7 to 10 show check patterns composing the test patterns 50 and 51. Referring to FIG. 7, a paper feeding distance check pattern 60 checks deviation in the feeding distance of the recording paper 11 in the sub scan direction. In recording the paper feeding distance check pattern 60, the system controller 30 provides the pulse motor 17 with drive pulses the number of which corresponds to feeding the recording paper 11 by one line or for predetermined time. The check pattern 60 includes plural paper feeding distance check lines 61*a* to 61*c* which are recorded by the same recording devices, for example, first, tenth and twentieth nozzles, whenever the recording paper 11 is fed by one line or predetermined time.

Measuring distance L1 between the check lines 61*a* recorded by the first nozzle, for example, makes it possible to detect deviation in the feeding distance in the sub scan direction on the basis of difference between the measurement value of L1 and its design value. A correction value of the feeding distance is obtained on the basis of the amount of deviation. It is preferable to record approximately ten check lines 61*a* to 61*c*, for accurate correction. It is preferable that the correction value of the feeding distance is determined by the average of the amounts of deviation obtained by each of the check lines 61*a* to 61*c*. Instead of obtaining the correction value from one of three types of check lines 61*a* to 61*c*, the correction value may be determined by the average of deviations obtained by all the three types of check lines 61*a* to 61*c*.

Figure 8:
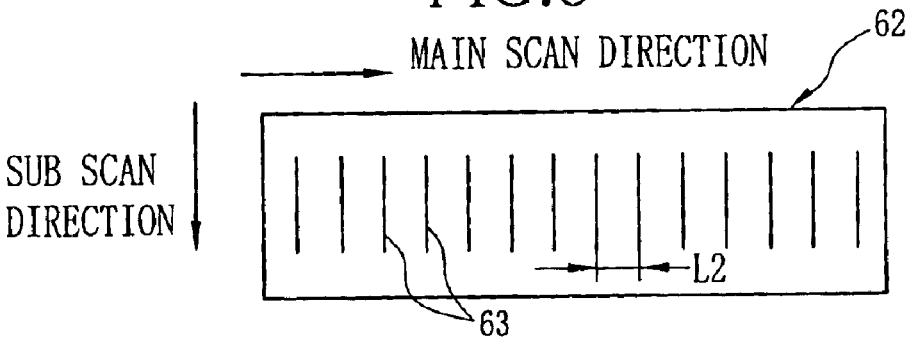
FIG. 8 is an explanatory view showing an example of a head movement check pattern.

FIG. 8 shows a head movement check pattern 62. The check pattern 62 includes head carrying distance check lines 63 which are recorded by nozzle line of one color, a cyan nozzle line 23 for instance, in the sub scan direction. The head movement check line 63 is recorded whenever the head carriage 16 carries the inkjet head 15 by the predetermined number of pulses. Measuring distance L2 between the check lines 63 in the main scan direction makes it possible to obtain the deviation in the carrying distance of the head carriage 16, on the basis of difference between the measurement value of L2 and its design value. A correction value of the carrying distance is obtained from the amount of deviation. Corrected movement of the inkjet head 15 is the sum of actual movement and the correction value. In a case where the distance L2 varies in the main scan direction, the correction value may be determined on the basis of the distribution thereof.

Figure 9:
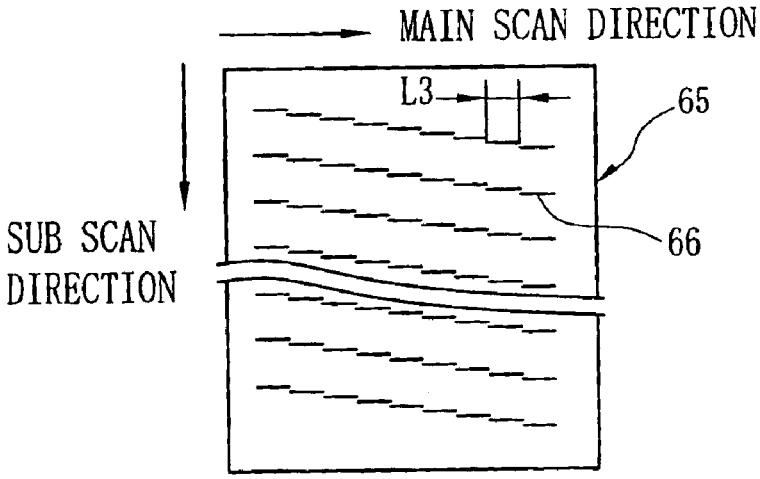
FIG. 9 is an explanatory view showing an example of a faulty recording device check pattern.

FIG. 9 is a faulty recording device check pattern 65 for detecting a nozzle malfunction due to clogging and the like. The faulty recording device check pattern 65 includes faulty recording device check lines 66 in the main scan direction recorded by each nozzle. For instance, check lines 66 of a predetermined length are recorded by use of first, tenth, and nineteenth nozzles. Then, similar check lines 66 are recorded by use of second, eleventh, and twentieth nozzles. The other nozzles also record the check lines 66 in the same way. The length of the check lines 66 in the main scan direction, and the interval thereof in the sub scan direction are properly decided based on the size of a check pattern. It is possible to detect the malfunction of the nozzle by checking if the corresponding check line 66 is faded. For example, the malfunction of the nozzle may be detected when the measured length L3 of the check line 66 does not reach a predetermined value. Deviation in the movement of the recording head may be detected on the basis of difference between the measurement value of L3 and its design value.

In FIGS. 7 to 9, first check pattern is defined as check pattern recorded by the same recording device driven at predetermined time intervals, and second check pattern is defined as check pattern recorded by the same recording device driven for predetermined elapsed time. Then, the paper feeding distance check patterns 60 shown in FIG. 7 and the head movement check patterns 62 shown in FIG. 8 correspond to the first check patterns. The faulty recording device check pattern 65 shown in FIG. 9, as described above, can be used as head movement check pattern which corresponds to the second check pattern.

Figure 10:
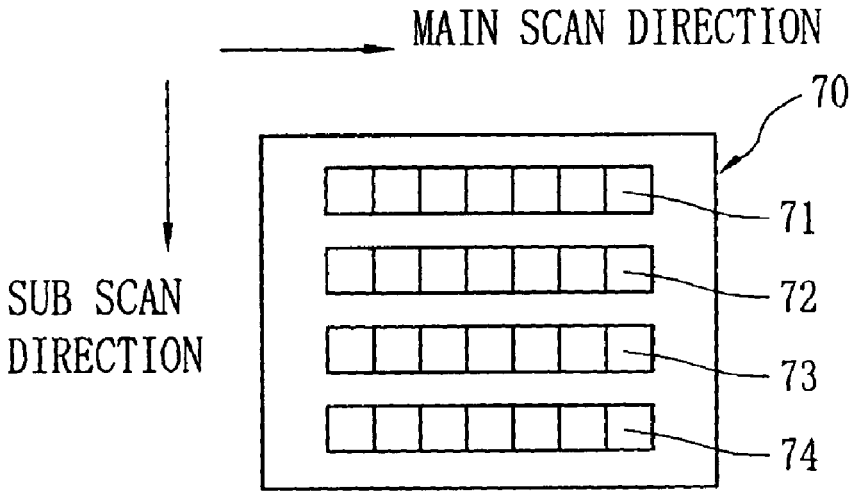
FIG. 10 is an explanatory view showing an example of a density check pattern.

Referring to FIG. 10 a density check pattern 70 includes calibration patterns 71 to 74 in which the density of each color is varied step by step. It is possible to detect the density imperfection by comparing the density of each area of the calibration patterns 71 to 74 with standard density. When the density imperfection is detected, a calibration correction, such as the change of the size of ink droplets and the like, is carried out to achieve proper density. The calibration correction can decrease deviation in density caused by some reasons, such as increase in temperature of the inkjet head 15 and ink, and deterioration in the ink.

Figure 11:
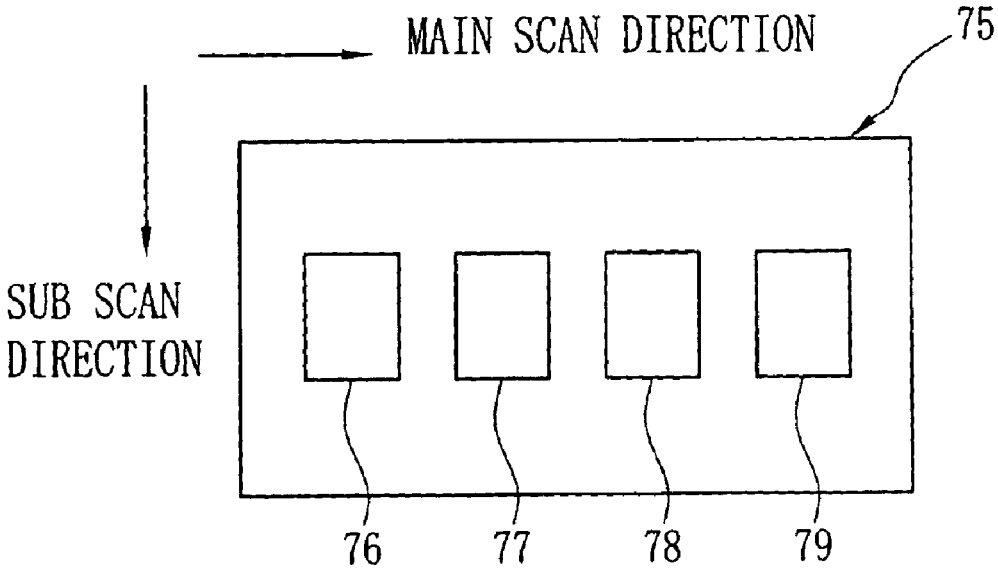
FIG. 11 is an explanatory view showing an example of a solid fill check pattern.

Referring to FIG. 11, a solid fill check pattern 75 includes solid fill patterns 76 to 79 of each color. The occurrence of density deviation is detected by the solid fill patterns 76 to 79. It is also possible to detect the faulty recording device and deviation in the feeding distance of the recording paper 11, by the appearance of a black or white streak in the solid fills 76 to 79. Only the solid fill patterns 76 to 79 make it difficult, however, to judge that which of the faulty nozzle or the feeding distance deviation causes the black or white streak. Therefore, it is preferable to use either of the paper feeding distance check pattern 60 and the faulty recording device check pattern 65 with the solid fill check pattern 75. According to the present invention, it is possible to reduce the streak caused by deviation in the feeding distance of the recording paper 11 or in the movement of the inkjet head 15.

The check patterns 60, 65, 70 and 75 described above are just examples. The shape, location and the like thereof are properly changed. The test patterns 50 and 51 are a combination of the check patterns 60, 65, 70 and 75. The combination of the check patterns 60, 65, 70 and 75 are properly changed on the basis of frequency in the use of each check pattern. For example, deviation in density is relatively small, so the density check pattern 70 and the solid fill check pattern 75 may be used less often than the paper feeding distance check pattern 60 and the faulty recording device check pattern 65. Using other check patterns with the check patterns 60, 65, 70 and 75 makes it possible to prevent general print imperfection.

When the test print mode is selected, the camera 46 takes the image of the printed test pattern 50. Then, image data of the test pattern 50 is sent to the test pattern analyzer 97. The test pattern analyzer 97 judges the occurrence of print imperfection from image data. In a case where the print imperfection is detected, various correction processes are carried out. If a nozzle malfunction is detected, for example, the faulty nozzle is subject to various cleaning processes, such as a nozzle wiping process, an ink suction process, a discharge process and the like. In the nozzle wiping process referred to as blading or wiping, an elastic member wipes out ink dust and paper dust adhering to a nozzle hole. In the suction process referred to as pumping, the ink is forcefully sucked from the nozzle hole. In the discharge process referred to as purging, a certain amount of ink is discharged from all or a part of nozzles.

If the print imperfection is still detected after the cleaning, a warning message is displayed on the display panel 33 to inform the user of ink clogging. Then, the user sets the inkjet printer 92 in a cleaning mode, to further clean the faulty nozzle. In the cleaning mode, the ink in the nozzle is heated by a heating element (not illustrated) and powerfully discharged therefrom, so that the faulty nozzle is effectively cleaned up.

The camera 46 of the test pattern imaging device 96 requires higher resolution than the accuracy of image recording. In a case of carrying a measurement system for measuring the feeding distance of the recording paper 11, the camera carrying mechanism 47 differs from a recording paper feeding mechanism. The camera carrying mechanism 47 must have higher accuracy than the recording paper feeding mechanism. In this embodiment, each test pattern is checked with the use of the camera 46, but a line sensor or an area sensor may be used instead.

In the shuttle scan system of a serial printer, a streak extending to the sub scan distance appears in the solid fill check pattern 75, when the feeding distance of the recording paper 11 deviates from a standard value. In a line printer, as described later, the length of a recorded image is varied in the feeding direction of the recording paper 11. Variation in the length of the recorded image becomes variation in the density thereof. In other words, when the image is compressed due to the short feeding distance, the density becomes high. When the image is stretched due to the long feeding distance, on the other hand, the density becomes low. The deviation in the feeding distance of the recording paper 11 is detected by variation in the density of the recorded image and in the width of the streak.

In this embodiment, the piezoelectric elements are disposed in the ink flowing path. A heating element for heating the ink, however, may be disposed instead of the piezoelectric element. In that case, air bubbles generated by heating the ink discharges the ink. In the above embodiment, the inkjet printer 92 is provided with the ink of four colors, namely yellow, magenta, cyan, and black. The ink of light magenta, light cyan, dark yellow and the like may be provided therein in addition to that. In the inkjet head 15 of the above embodiment, the nozzles of each color are arranged in a single line, but may be arranged in plural lines.

In the above embodiment, the printer 92 contains the test pattern imaging device 96, but a test pattern imaging device may be independently provided. The test pattern imaging device having a flathead scanner, for example, may be used for detecting the faulty nozzle. The camera is used in the test pattern imaging device 96 in the above embodiment, but a relatively movable line sensor may be used for imaging the test pattern. Non-contact measurement methods such as a laser Doppler method, a laser speckle method and the like may be used for measuring the feeding distance of the recording paper 11.

Figure 12:
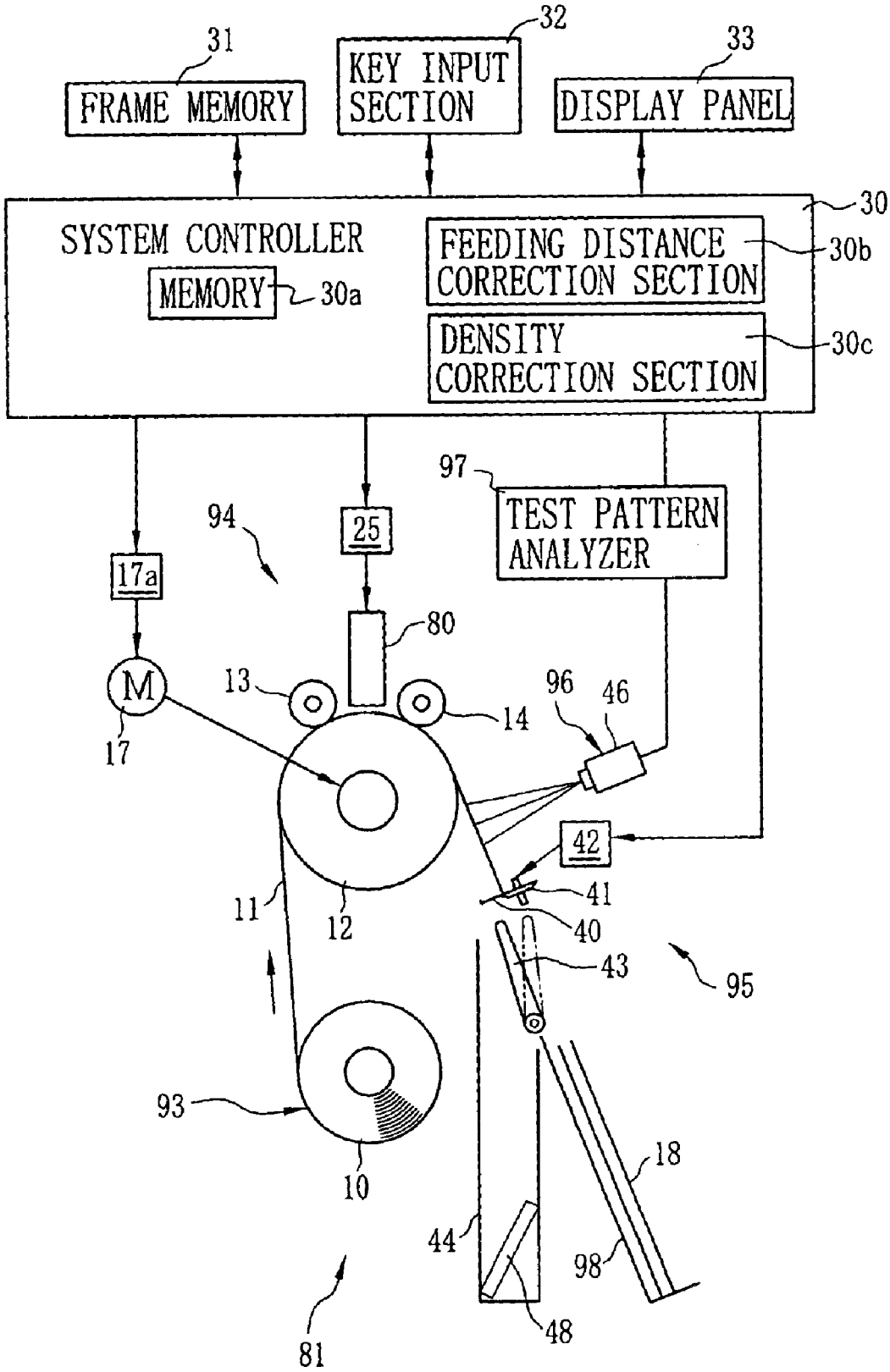
FIG. 12 is a schematic view of a line print type of an inkjet printer.
Figure 13:
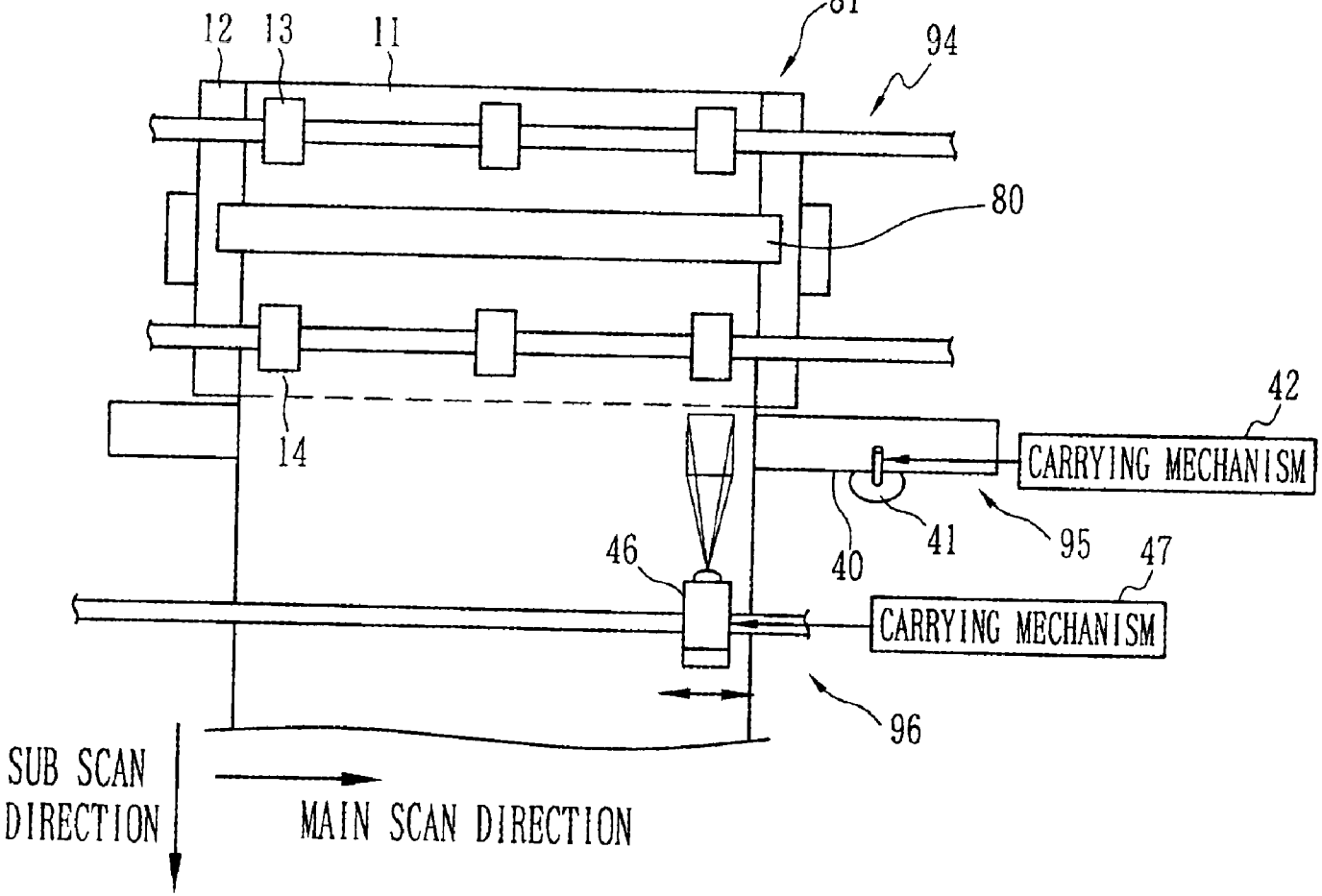
FIG. 13 is a plan view of a printing device and a test pattern imaging device in the printer of FIG. 12.

In the above embodiment, the image recording apparatus according to the present invention is installed in the serial printer. The image recording apparatus, however, may be installed in a line printer. Referring to FIGS. 12 and 13, a line printer 81 is provided with a line head 80 in which nozzles are neatly arranged in parallel with the width direction of the recording paper 11. In FIGS. 12 and 13, the same reference numbers are applied to identical components to FIGS. 1 and 2, and the description thereof is omitted.

The line head 80 is disposed in the width direction of the recording paper 11 (the main scan direction). The line head 80 has yellow (Y) nozzles, magenta (M) nozzles, cyan (C) nozzles, and black (K) nozzles. The nozzles of each color are neatly aligned along the main scan direction. The line printer 81 may be provided with plural line heads each of which has nozzles of a single color. In this case, an ink dryer head is disposed between each of the line heads. The ink dryer head may be provided with an air blower for blowing air on the recording paper 11, a heater disposed opposite to the recording paper 11, or both of the air blower and the heater.

The line printer 81 sequentially drives the nozzles from one end of the line head 80 to print an image of one line in the main scan direction. The way to drive the nozzles is not limited to it, but the nozzles divided into some blocks may be sequentially driven on a block basis. All nozzles arranged in the line head 80 may be driven at the same time.

The platen roller 12 rotated by the pulse motor 17 feeds the recording paper by one line in the sub scan direction, whenever the line head 80 prints an image of one line in the main scan direction. Repeating or carrying out at the same time the above operations makes it possible to record an image of one picture frame.

There are various types of line heads such as an inkjet head, a thermal head, and a LED array head and the like. The LED array head is used in an optical recording (exposure) method. There are various types of the thermal heads, such as a sublimation type, a wax transfer type, and a direct thermal type. The sublimation type and wax transfer type of printers use an ink ribbon. The direct thermal type of a thermal printer, on the other hand, uses a direct thermal type of recording paper in which a thermosensitive cyan coloring layer, a thermosensitive magenta coloring layer, and a thermosensitive yellow coloring layer are formed atop another on one side of a base material. The three coloring layers have different heat-sensitivities from each other. Each coloring layer has an absorption spectrum whose peak wavelength is specific, and loses coloring ability when it is exposed to ultraviolet rays of this wavelength range. Accordingly, the upper coloring layers, i.e. the yellow and magenta coloring layers, are unaffected by heat applied to the coloring layer under them. In the optical recording method, a recording paper has to be developed after optical recording. As in the case of the line head, the inkjet head, the thermal head, the LED array head and the like may be used as the serial type of shuttle head. The serial type of shuttle head, however, is hardly used in the direct thermal method which needs a complex optical fixing mechanism.

In the line printer 81, as shown in FIG. 6, the width L4 of the margin 54 is shorter than the length L5 of the line head 80 shown by double-dashed lines. In this case, the line head 80 is so carried in the main scan direction as to record the check patterns with using all nozzles. Also in a case of the margin 53 extending to the width direction of the recording paper 11, as shown in FIG. 5, the line head 80 is moved in the width direction of the recording paper 11 to move the nozzles inside the check patterns 61, 65 and 70. Therefore, the check patterns are recorded with the use of all nozzles.

Figure 14:
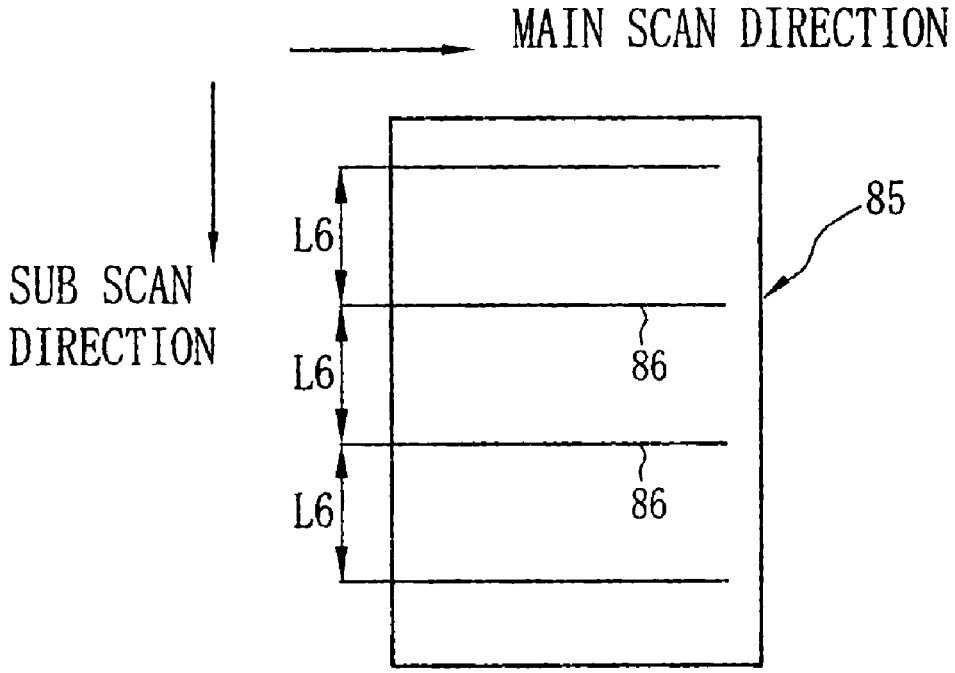
FIG. 14 is an explanatory view showing an example of a paper feeding distance check pattern in the printer of FIG. 12.

In a paper feeding distance check pattern 85 for the line printer 81, as shown in FIG. 14, while a recording device records one check line 86 in the main scan direction, the recording paper 11 is fed for a fixed period of pulses or time in the sub scan direction. Then, the same recording device records another check line 86. Comparing actual distance L6 between the check lines 86 with a value set at the fixed period of pulses or time makes it possible to calculate a correction value. In the line printer which carries the line head instead of feeding the recording paper, various check patterns are recorded in a like manner. The print imperfection is detected by the analysis results of the check patterns, and various correction processes are carried out.

Figure 15:
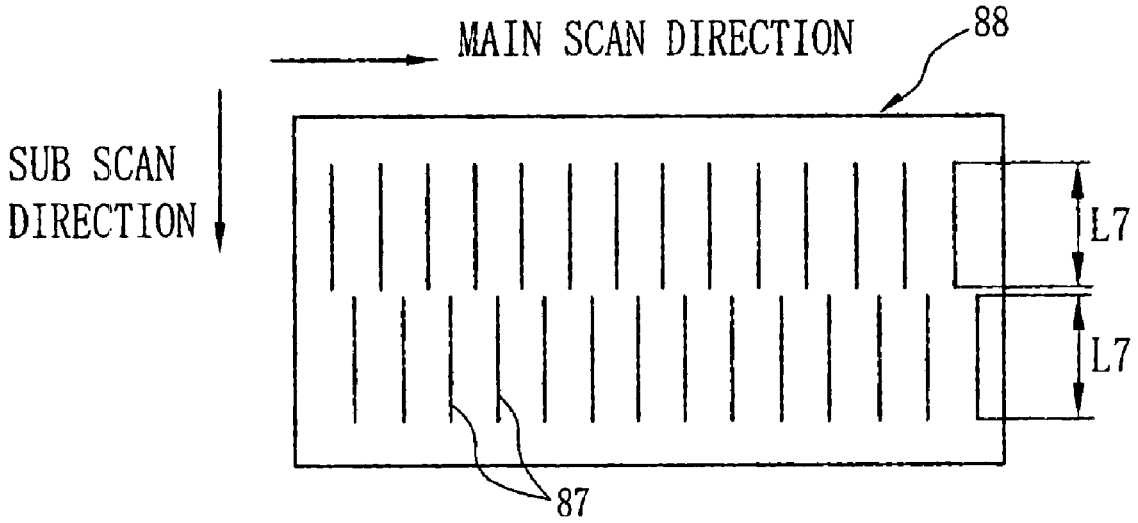
FIG. 15 is an explanatory view showing another example of the paper feeding distance check pattern in the printer of FIG. 12.

In the line printer 81, it is possible to use a paper feeding distance check pattern 88 as shown in FIG. 5 instead of the paper feeding distance check pattern 85 shown in FIG. 14. The paper feeding distance check pattern 88 includes check lines 87 extending in the sub scan direction which are recorded by a predetermined recording devices driven for predetermined time. Measuring the length L7 of the check line 87 makes it possible to obtain deviation in feeding distance of the recording paper, on the basis of difference between the measurement value of L7 and its design value. The paper feeding distance check pattern 85 shown in FIG. 14 corresponds to the first check pattern, and the paper feeding distance check pattern 88 shown in FIG. 15 corresponds to the second check pattern.

The check patterns make it possible to detect deviation in the relative movement or relative speed between the recording paper and the recording head from the check patterns, and therefore it is possible to correct the relative speed on the basis of the detected deviation. The relative speed between the recording paper and the recording head may be corrected by changing the pulse rate of the pulse motor.

In the line printer, it is possible to reduce the deviation in the magnification of the image in the sub scan direction (longitudinal magnification). In the line printer, it is possible to record a high-definition image by adopting a pixel-offset method in which the line head is displaced by, for example, half-pixel in the main scan direction. The line head may move in the main scan direction to the margin between the image area and one side edge of the recording paper, for the purpose of recording words in the margin. Instead of the words, the image maybe recorded across from edge to edge of the recording paper in the main scan direction. The recording elements of the line head may be arranged in plural lines in a staggered configuration, besides in a single line in the main scan direction.

In the above embodiment, the inkjet printer can detect an ink clogging of each nozzle, a malfunction of a drive device of each nozzle, deviation in feeding distance of the recording paper and the like. The present invention may be applicable to other recording types of printer, such as a thermal recording type, an exposure recording type, to detect similar malfunctions.

The interval of the test patterns 50 and 51 are more than one picture frame. The test patterns 50 and 51 may be recorded when the printer is powered. The test patterns 50 and 51 maybe recorded, whenever the predetermined number of images, for example, ten or one hundred, are recorded. If the test patterns 50 and 51 are printed before shipment or for user maintenance, it is possible to manually adjust the feeding distance of the recording paper and the movement of the recording device. When the recording paper roll 10 is exchanged, the type, thickness and width of the recording paper 11 are detected by a bar code recorded on a shaft. In that case, it is possible to display a message of whether to record the test patterns based on detection result. The printer may automatically record the test patterns to carry out the various correction processes.

When it turns out that the correction processes are necessary after completing the record of images, the printer may predict an image in which print imperfection begins by use of a previous test pattern, and may automatically rerecord images after the predicted one. It is possible to set the predicted image as the one positioned at 70 percent between the prior test pattern and the present test pattern. The position of the predicted image is properly changeable. Instead of rerecording, the printer may display a warning message on the display panel 33, so that the user can select the number of rerecording and execute it.

In the above embodiment, a roll type of recording paper is used. The present invention, however, is applicable to a printer using a cut sheet type recording paper. In this case, various check patterns recorded outside of an image print area may be cut out later with a cutter. The various check patterns may be recorded all over the sheet as a test print.

Although the present invention has been described with respect to the preferred embodiment, the preset invention is not to be limited to the above embodiment but, on the contrary, various modifications will be possible to those skilled in the art without departing from the scope of claims appended hereto.

What is claimed is:

1. An image recording apparatus comprising:

a recording head for recording an image, said recording head having plural recording elements arranged along a first direction, said recording head moving relatively to a recording material to record a test pattern in a margin of said image;

detection means for detecting said recorded test pattern;

a test pattern analyzer for analyzing signals from said detection means, said test pattern analyzer calculating deviation in relative movement or relative speed of said recording material or said recording head; and a correction means for correcting said relative movement or said relative speed on the basis of said deviation calculated by said test pattern analyzer, wherein said test pattern includes a first check pattern, said first check pattern comprises plural first check lines recorded by driving the same recording device at predetermined time intervals on the basis of predetermined drive signals, while said recording material is relatively moved to said recording head, and wherein said test pattern analyzer measures distance between said first check lines to determine deviation in said relative movement or said relative speed.

2. An image recording apparatus comprising:

a recording head for recording an image, said recording head having plural recording elements arranged along a first direction, said recording head moving relatively to a recording material to record a test pattern in a margin of said image;

detection means for detecting said recorded test pattern;

a test pattern analyzer for analyzing signals from said detection means, said test pattern analyzer calculating deviation in relative movement or relative speed of said recording material or said recording head; and a correction means for correcting said relative movement or said relative speed on the basis of said deviation calculated by said test pattern analyzer, wherein said test pattern includes a second check pattern, said second check pattern comprises plural second check lines recorded by driving the same said recording device for predetermined time on the basis of predetermined drive signals, while said recording material is relatively moved to said recording head, and wherein said test pattern analyzer measures the length of said second check line to determine deviation in said relative movement or said relative speed.

3. An image recording apparatus comprising:

a recording head for recording an image, said recording head having a plural recording elements arranged along a first direction, said recording head moving relatively to a recording material to record a test pattern in a margin of said image;

detection means for detecting said recorded test pattern;

a test pattern analyzer for analyzing signals from said detection means, said test pattern analyzer calculating deviation in relative movement or relative speed of said recording material or said recording head; and a correction means for correcting said relative movement or said relative speed on the basis of said deviation calculated by said test pattern analyzer, wherein said test pattern includes at least one of a faulty recording device check pattern, a calibration pattern, and a solid fill check pattern.

4. An image recording apparatus comprising:

a recording head for recording an image, said recording head having plural recording elements arranged along a first direction, said recording head moving relatively to a recording material to record a test pattern in a margin of said image;

detection means for detecting said recorded test pattern;

a test pattern analyzer for analyzing signals from said detection means, said test pattern analyzer calculating deviation in relative movement or relative speed of said recording material or said recording head; and a correction means for correcting said relative movement or said relative speed on the basis of said deviation calculated by said test pattern analyzer, wherein said test pattern is recorded in a margin provided between said images recorded continuously.

5. An image recording apparatus comprising:

a recording head for recording an image, said recording head having plural recording elements arranged alone a first direction, said recording head moving relatively to a recording material to record a test pattern in a margin of said image;

detection means for detecting said recorded test pattern;

a test pattern analyzer for analyzing signals from said detection means, said test pattern analyzer calculating deviation in relative movement or relative speed of said recording material or said recording head; and a correction means for correcting said relative movement or said relative speed on the basis of said deviation calculated by said test pattern analyzer, wherein said test pattern is recorded in a margin provided between said image and a side edge of said recording material.

6. An image recording apparatus comprising:

a recording head for recording an image, said recording head having plural recording elements arranged along a first direction, said recording head moving relatively to a recording material to record a test pattern in a margin of said image;

detection means for detecting said recorded test pattern;

a test pattern analyzer for analyzing signals from said detection means, said test pattern analyzer calculating deviation in relative movement or relative speed of said recording material or said recording head; and a correction means for correcting said relative movement or said relative speed on the basis of said deviation calculated by said test pattern analyzer, further comprising:

a head carriage for carrying said recording head in a second direction orthogonal to said first direction; and a recording material feeding device for feeding said recording material in said first direction, said image being serially recorded by repeating to carry said carriage and to feed said recording material by use of said recording material feeding device.

7. An image recording apparatus comprising:

a recording head for recording an image, said recording head having plural recording elements arranged alone a first direction, said recording head moving relatively to a recording material to record a test pattern in a margin of said image;

detection means for detecting said recorded test pattern;

a test pattern analyzer for analyzing signals from said detection means, said test pattern analyzer calculating deviation in relative movement or relative speed of said recording material or said recording head; and a correction means for correcting said relative movement or said relative speed on the basis of said deviation calculated by said test pattern analyzer, further comprising:

a recording material feeding device for feeding said recording material in a second direction orthogonal to said first direction, said image being linearly recorded by repeating or carrying out at the same time to record said image in said first direction and to carry said recording material in said second direction.

8. An image recording apparatus as recited in claim 7, wherein said recording head moves in said first direction for a pixel-offset.

9. An image recording apparatus as recited in claim 7, wherein said recording head moves in said first direction to record said image, said first check patterns, or said second check patterns in an area between said image and the lateral edge of said recording material.

10. An image recording apparatus comprising:

a recording head for recording an image, said recording head having plural recording elements arranged along a first direction, said recording head moving relatively to a recording material to record a test pattern in a margin of said image;

detection means for detecting said recorded test pattern;

a test pattern analyzer for analyzing signals from said detection means, said test pattern analyzer calculating deviation in relative movement or relative speed of said recording material or said recording head; and a correction means for correcting said relative movement or said relative speed on the basis of said deviation calculated by said test pattern analyzer, wherein said detection means is a camera for taking an image of said test pattern.

11. An image recording apparatus comprising:

a recording head for recording an image, said recording head having plural recording elements arranged along a first direction, said recording head moving relatively to a recording material to record a test pattern in a margin of said image;

detection means for detecting said recorded test pattern;

a test pattern analyzer for analyzing signals from said detection means, said test pattern analyzer calculating deviation in relative movement or relative speed of said recording material or said recording head; and a correction means for correcting said relative movement or said relative speed on the basis of said deviation calculated by said test pattern analyzer, further comprising:

a material cutter for cutting said test pattern recorded in said margin of said image; and a guide member for guiding said test pattern cut by said material cutter to a waste material box.

* * * * *